US005901447A

United States Patent [19]

Dunning

[11] Patent Number: 5,901,447

[45] Date of Patent: May 11, 1999

[54] SHEARING DEVICE

[75] Inventor: Neil Raymond Dunning, Charlestown, Australia

[73] Assignee: Gasweld Pty. Ltd., New South Wales, Australia

[21] Appl. No.: 08/812,120

[22] Filed: Mar. 5, 1997

[30] Foreign Application Priority Data

Mar. 7, 1996 [AU] Australia ..... PN8516

[51] Int. Cl.[6] ..... B26B 15/00

[52] U.S. Cl. ..... 30/228; 30/500

[58] Field of Search ..... 30/228, 216, 210, 30/300, 122, 238

[56] References Cited

U.S. PATENT DOCUMENTS

| | | | |
|---|---|---|---|
| 2,760,265 | 8/1956 | Draenert | 30/258 X |
| 3,025,599 | 3/1962 | Sauers et al. | 30/228 |
| 4,109,381 | 8/1978 | Pellenc | 30/228 |
| 4,173,069 | 11/1979 | Sidenstick et al. | 30/228 |
| 4,903,408 | 2/1990 | Tagawa et al. | 30/228 |

*Primary Examiner*—Douglas D. Watts
*Attorney, Agent, or Firm*—Ladas & Parry

[57] ABSTRACT

A shearing device for cutting boards of particulate material, or similar, having a body adapted for fastening to a drill, and first and second cutting blades fixed to the body, each cutting blade having a curved cutting edge extending to a forward tip of its respective cutting blade. A third cutting blade is pivotably mounted to reciprocate in a plane between the first and second cutting blades the third cutting blade having curved cutting edges extending to a forward tip of the third cutting blade so as to cooperate with the first and second cutting blades to perform the cutting operation. The third cutting blade is spaced from the first and second blades by spaces to provide a clearance of 1 to 3 mm.

18 Claims, 4 Drawing Sheets

SHEARING DEVICE

TECHNICAL FIELD

This invention relates to shearing devices and in particular to a shearing device adapted for operation in association with a drill to cut through boards of material.

BACKGROUND OF THE INVENTION

There is currently available a shearing device for cutting boards of particulate material and the like, which attaches to the chuck end of a drill. Two fixed outer cutting blades are attached to a body with a third movable centre cutting blade adapted to pivot in a plane centrally between the outer cutting blades, such that the device performs a scissor cutting action with the centre blade moving relative to the outer cutting blades. The centre cutting blade is pivotally driven by an eccentric cam driving cam following surfaces on arms extending from an end of the centre cutting blade. The eccentric cam is fastened to, and driven by, a drill attached to the body.

The cutting blades are positioned closely together such that there is minimal clearance between the cutting edges of the blades as the centre cutting blade pivots. The cutting edges are straight or substantially straight and manufactured from steel.

The prior art device is capable of cutting through material only up to about 4 mm thick and produces dust from the material when cutting, which can be a serious respiratory hazard. The cutting edges and cam following surfaces are also subject to high wear rates.

OBJECT OF THE INVENTION

It is an object of the present invention to provide an improved shearing device.

SUMMARY OF THE INVENTION

There is disclosed herein a shearing device for cutting boards of particulate material, or similar, comprising:

a body adapted for fastening to a drill, first and second cutting blades each fixed to said body, each said cutting blade having a curved cutting edge, a third cutting blade adapted to reciprocate in a plane between said first and second cutting blades, said third cutting blade having cutting edges and being free to pivot about an axis so as to cooperate with said first and second cutting blades to perform a cutting operation, and means for pivoting said third cutting blade.

Preferably said body is manufactured from an aluminium alloy.

Preferably said first through third cutting blades are manufactured from mild steel.

Preferably said first through third cutting blades are case hardened.

Preferably said first through third cutting blades have a surface roughness of 2 to 5 micron.

Preferably said first through third cutting blades have inserts forming or substantially forming said cutting edges.

Preferably said inserts are manufactured from tungsten carbide.

Preferably said first and second cutting blades have a thickness of 3 to 10 mm.

Preferably said curved first and second cutting blade cutting edges are curved convexly.

More preferably said convexly curved first and second cutting edges have a radius of 90 to 150 mm.

Preferably said third cutting blade has a thickness of 4 to 12 mm.

Preferably said third cutting blade cutting edges are curved.

More preferably said third cutting blade cutting edges are curved concavely.

Most preferably said concavely curved third cutting blade cutting edges have a radius of 40 to 80 mm.

Preferably said first and second cutting blades are separated from said third cutting blade by spacer plates.

Preferably said spacer plates are 1 to 3 mm thick.

Preferably said means for pivoting said third blade comprises a cam fixed to said drill rotating in an eccentric orbit by operation of said drill and cam following surfaces on said third blade, contact of said cam on said cam following surfaces pivoting said third blade about said axis to form an oscillatory scissor action between said third blade and said first and second blades.

Preferably said cam following surfaces are convexly curved.

Preferably at least one of said cam following surfaces is formed by or substantially formed by a further insert.

Preferably said further insert is manufactured from tungsten carbide.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
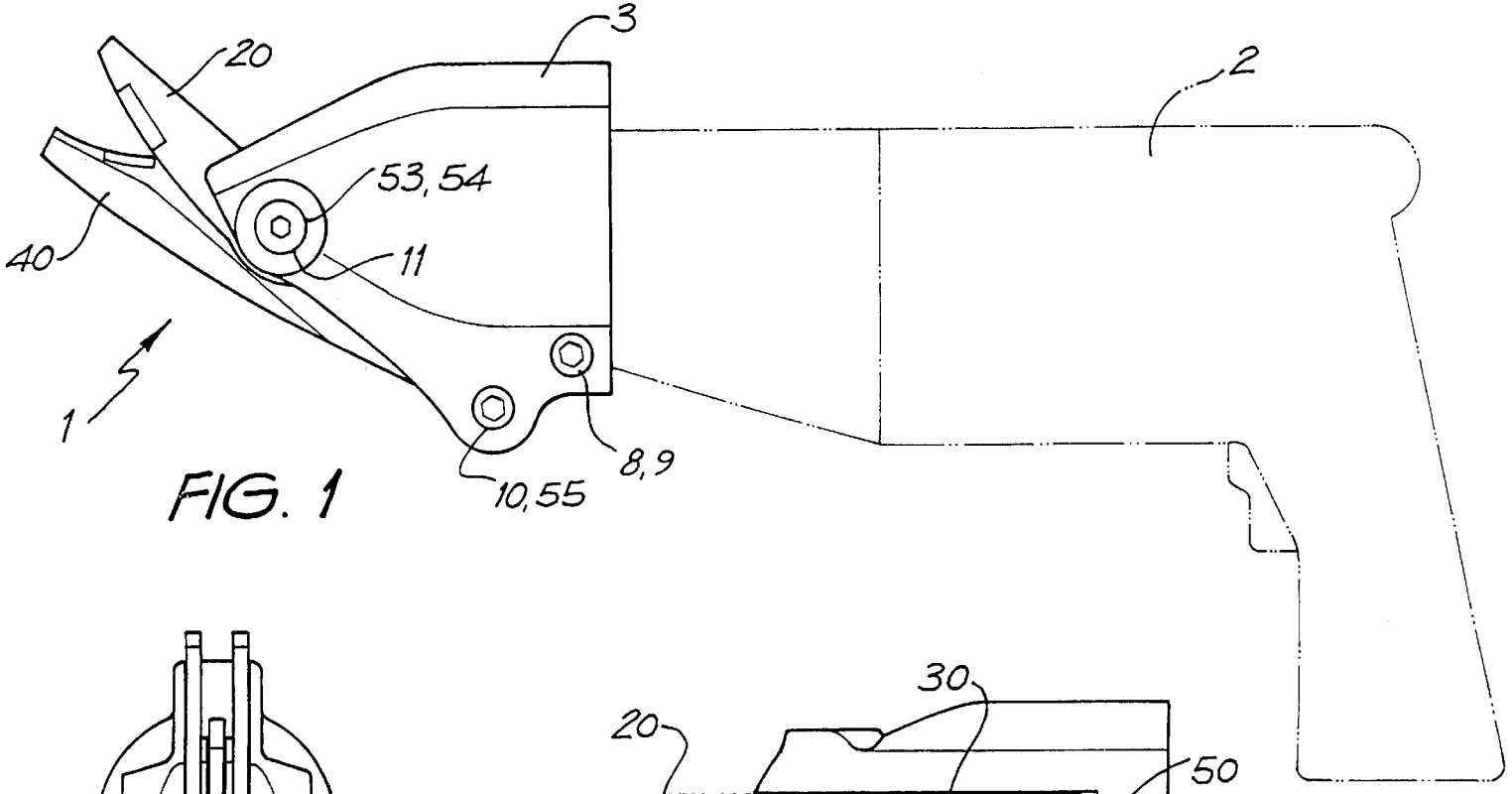
FIG. 1 is a schematic side elevation view of a shearing device attached to a drill.
Figure 2:
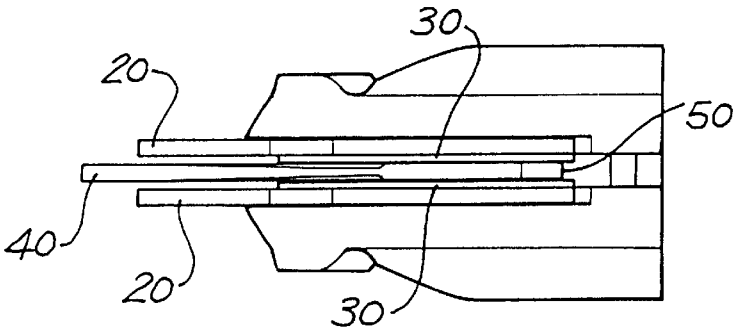
FIG. 2 is a schematic underside plan view of the shearing device of FIG. 1.
Figure 3:
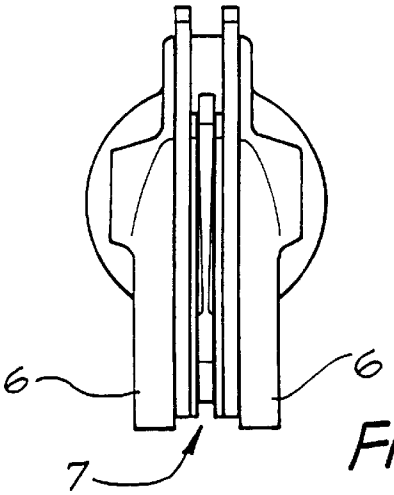
FIG. 3 is a schematic end elevation view of the shearing device of FIG. 1.

In the accompanying drawings there is schematically depicted a shearing device 1 fastened to a drill 2.

The shearing device 1 is provided with a body 3 which is preferably cast from an aluminium alloy and then machined. The body 3 has a substantially cylindrical cavity 4 with a circular opening 5 at one longitudinal end, the plane of the opening 5 being perpendicular to the longitudinal axis of the cavity 4. The body 3 and cavity 4 are tapered toward a longitudinally opposing end to the opening 5, symmetrically about a vertical longitudinally extending centre plane and asymmetrically about a horizontal centre plane. Two vertical parallel flanges 6 are incorporated along the underside length of the body, symmetrical about the vertical longitudinally extending centre plane of the body 3, forming an open slot 7 between the flanges 6 which meets with the cavity 4. A threaded hole 8 passes perpendicularly through the flanges 6 in proximity to the circular opening 5. A screw 9 is provided in the hole 8 which, when tightened, draws the flanges 6 horizontally toward each other in the region of the circular opening 5, deforming the circular opening 5 into a smaller area and providing a clamping force to secure the body 3 to the chuck housing of the drill 2 which is inserted into the circular opening 5. A further threaded hole 10 is provided perpendicularly through the flanges 6 part way along the flanges 6 and an unthreaded hole is provided perpendicularly through the flanges 6 toward the tapered end of the body 3. A longitudinally extending recess 12 is provided along the centre line of the upper wall of the cavity 4.

Figure 5:
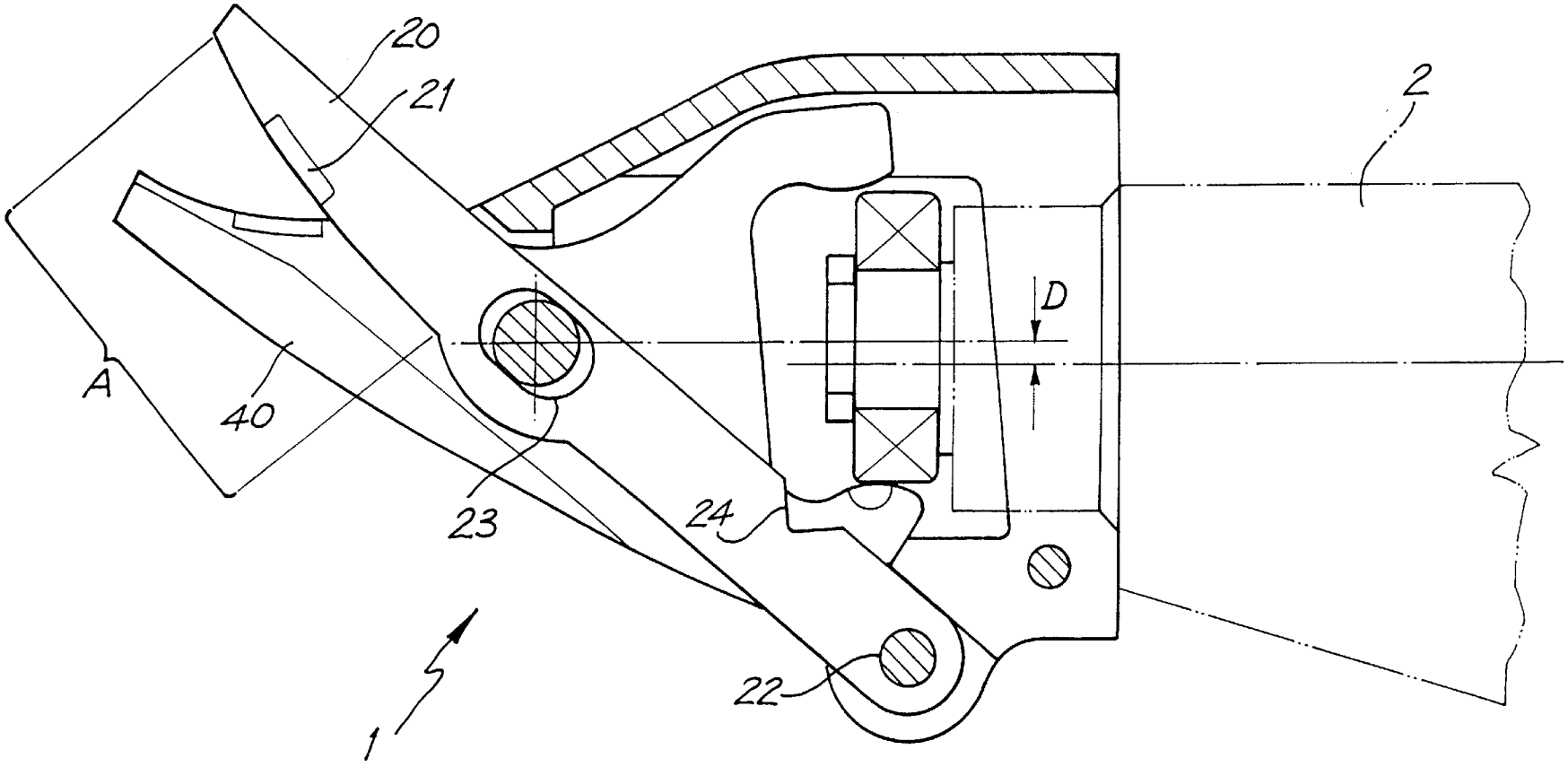
Figure 6:
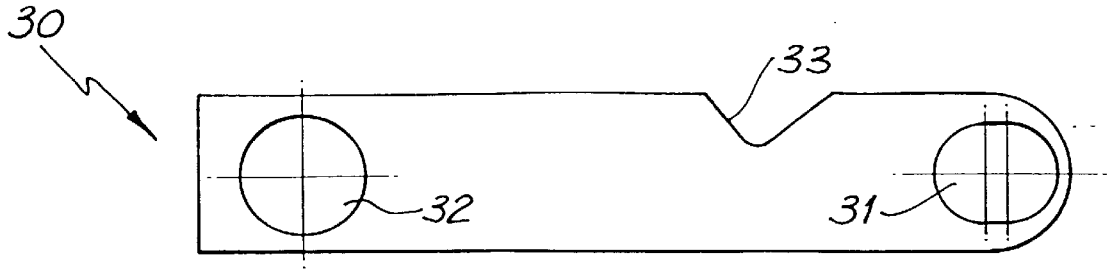
FIG. 6 is a schematic elevational view of a spacer plate employed in the shearing device of FIG. 1.
Figure 7:
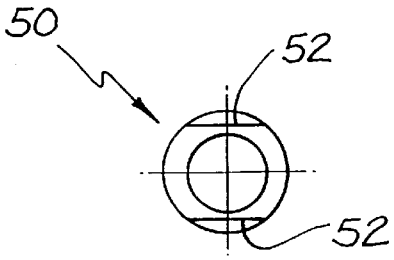
FIG. 7 is a schematic end elevational view of a first spacer bush employed in the shearing device of FIG. 1.
Figure 8:
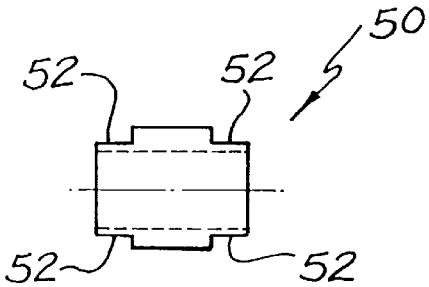
FIG. 8 is a schematic end side elevational view of the first spacer bush of FIG. 7.
Figure 9:
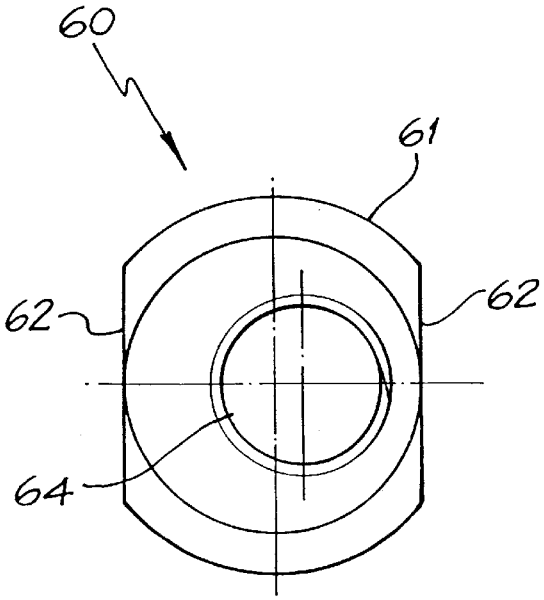
FIG. 9 is a schematic end elevational view of an eccentric nut employed in the shearing device of FIG. 1.
Figure 10:
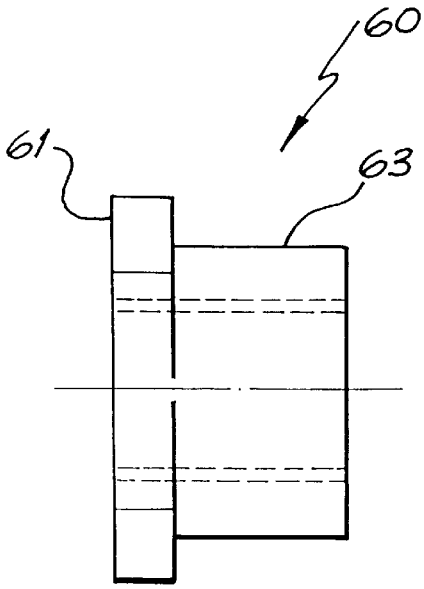
FIG. 10 is a schematic side elevational view of the eccentric nut of FIG. 9.

Two identical fixed outer cutting blades 20 are provided, preferably manufactured from mild steel with grain direction substantially parallel with a longitudinal axis of the blade 20, case hardened, having a final surface roughness of about 3.2 micron and a thickness of about 4 mm. The blades 20 are essentially flat, have a basic width essentially identical to that of the flanges 6 and are provided with a convexly curved cutting region marked A on FIG. 5, within which a tungsten carbide insert 21 is brazedly fixed to increase the hardness and durability of the cutting surface. Here the curved region A has a radius of about 100 mm, which is critical to cutting performance, and sharp right angled cutting edges are provided on both sides of the blade. The outer cutting blades 20 are provided with a circular hole 22 and slotted hole 23 with slot extending along a longitudinal axis of the blade 20, holes 22,23 aligning with holes 10,11 in the body 3 such that a longitudinal edge of the outer cutting blade 20 is flush with the lower edge of the flange 6, with the curved cutting region A protruding beyond the tapered end of the body 3 and facing in a generally downwards direction. A v-shaped cut out 24 is also provided on each outer cutting blade 20 such that the blade 20 does not impinge on the cavity 4 when aligned with the flange 6.

Two identical spacer plates 30 are also provided, preferably manufactured from mild steel with grain direction substantially parallel with a longitudinal axis of the spacer plate 30 and a final surface roughness of about 3.2 micron. The spacer plates 30 are essentially flat, and here have a thickness of about 1.2 mm which is critical to cutting performance, preventing or substantially preventing tearing or crushing a product and enhancing wearability. Each spacer plate 30 has essentially the same width as the outer cutting blades 20 and flanges 6 and is provided with a slotted hole 31, with slot extending along the longitudinal axis of the spacer plate 30, a circular hole 32 and a v-shaped cut out 33 which align with the circular hole 22, slotted hole 23 and cut out 24 respectively of the outer cutting blades 20.

Figure 4:
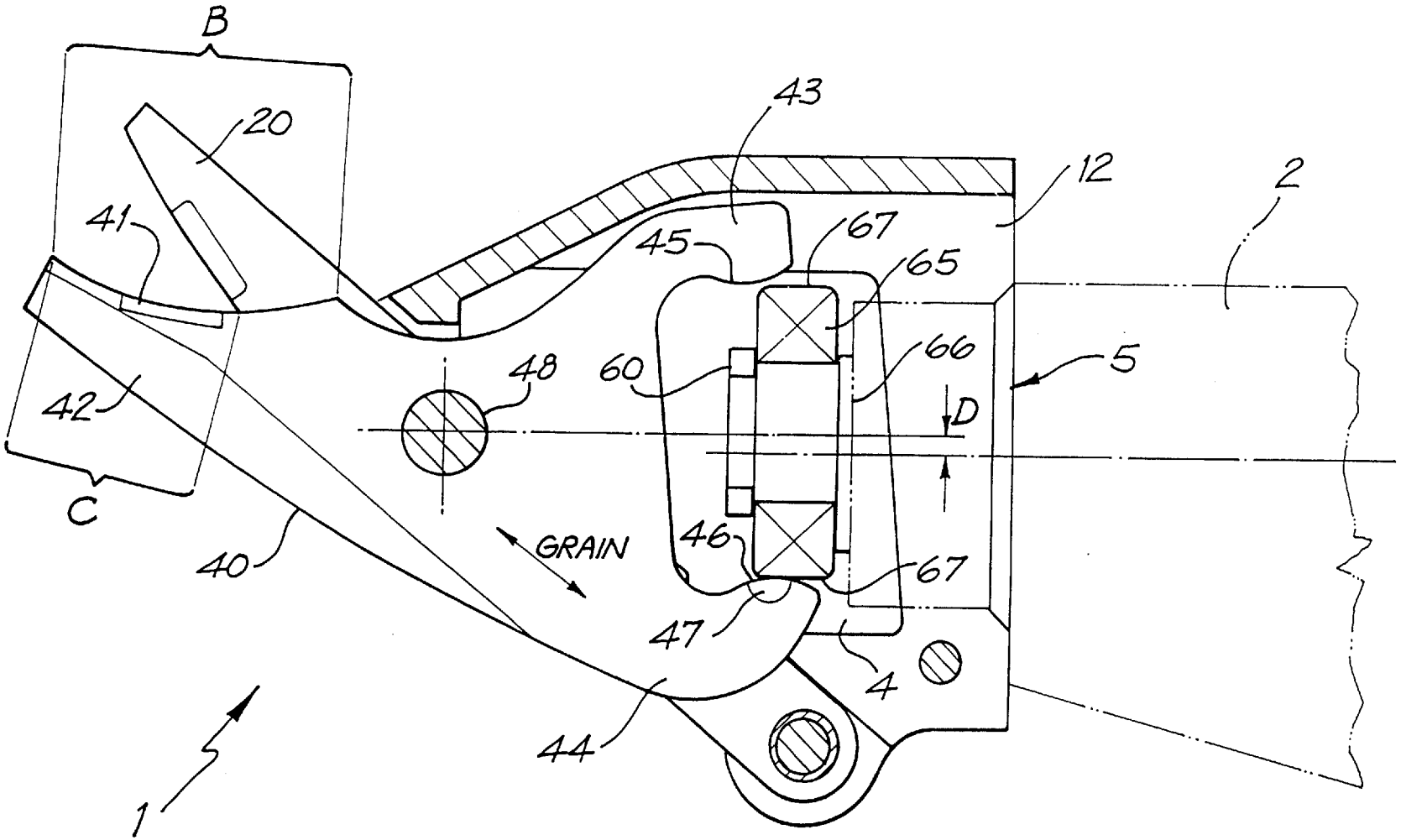
FIGS. 4 and 5 are schematic sectional side elevation views of the shearing device of FIG. 1 attached to a drill.

The shearing device 1 also provides a centre cutting blade 40, preferably manufactured from mild steel with grain direction substantially in the direction indicated in FIG. 4, case hardened, having a final surface roughness of about 3.2 micron and a thickness of about 5 mm. The blade 40 is flat and is provided with a concavely curved region marked B on FIG. 4 toward a tip of the blade 40, the curved region containing a cutting region marked C which further contains a further tungsten carbide insert 41 brazedly fixed to the blade 40 to increase the hardness and durability of the cutting surface. Here the curved region has a radius of about 46 mm, which is critical to cutting performance, and sharp right angled cutting edges on both sides of the blade within the cutting region C. A chamfer 42 is provided on the lower edges opposite the cutting region C. The centre cutting blade 40 further provides generally parallel upper and lower arms 43,44 extending generally longitudinally from a blade end opposite the cutting region C. The upper arm 43 provides a generally downward facing convexly curved cam following surface 45 whilst a similar upwardly facing convexly curved cam following surface 46 is provided on the lower arm 44. A yet further tungsten carbide insert 47 is brazedly fixed to form or substantially form the upwardly facing cam following surface 46 of the lower arm 44 to increase the hardness and durability of the surface. A circular hole 48 is provided generally central to the blade 40 structure in between the cutting region C and upper and lower arms 43,44.

To facilitate assembly of the body 3, outer cutting blades 20, spacer plates 30 and centre cutting blade 40, cylindrical spacer bushes 50,51 which are preferably manufactured from silver steel, hardened and tempered with a final surface roughness of about 3.2 micron, are provided. The first spacer bush 50 has diametrically opposed parallel flat surfaces 52 on the external wall of the bush toward both longitudinal ends of the spacer bush 50. The second spacer bush 51 has a constant circular cross-section throughout its length.

In assembly, spacer bush 50 is located centrally in circular hole 48 in the centre cutting blade 40, with sufficient clearance to allow relative rotation between the components. The spacer plates 30 are assembled horizontally either side of the centre cutting blade 40 with the circular hole 32 in the spacer plate 30 fitting onto the spacer bush 50 so that the slotted hole 31 lies toward the upper and lower arms 43,44 of the centre cutting blade 40 with the cut out 33 facing in a generally upward direction. The second spacer bush 51 is located through the slotted holes 31 of the spacer plates 30 such that the spacer plates 30 are rotationally fixed relative to each other. The outer cutting blades 20 are located horizontally beside the spacer plates 30 such that the slotted holes 23 slide onto the first spacer bush 50 with the flats 52 of the spacer bush 50 aligning parallel to the flat section of the slotted holes 23, rotationally fixing the spacer bush 50 to the outer cutting blade 20, and the circular hole 22 and cut out 24 align with the slotted hole 31 and cut out 33 respectively of the spacer plates 30.

The assembled centre cutting blade 40, spacer plates 30, spacer bushes 50,51 and outer cutting blades 20 are located in the body 3 such that the centre cutting blade 40 circular hole 48, first spacer bush 50, spacer plate 30 circular holes 32 and fixed outer cutting blade 20 slotted holes 23 are axially aligned with the body 3 unthreaded hole 11. A shoulder bolt 53 and knurled nut 54 fasten the assembly at the unthreaded hole 11. The spacer plates 30 and outer cutting blades 20 are further fastened to the body 3 by screw 55 through the body 3 threaded hole 10, the fixed outer cutting blades 20 circular holes 22, the spacer plates 30 slotted holes 31 and the second spacer bush 51.

The assembly results in the two outer cutting blades 20 being held fixedly to the flanges 6 with their longitudinal axis parallel to the flanges 6 and the cutting edge facing in a generally downwards direction. The centre cutting blade 40 is held pivotally by shoulder bolt 53, about the longitudinal axis of which it is free to rotate, with the cutting edge facing in a generally upwards direction. The cutting edges of the centre cutting blade 40 and outer cutting blades 20 are thus generally vertically opposed, and are horizontally offset by the thickness of the spacer plates 30. The upper and lower arms 43,44 of the centre cutting blade 40 protrude into the cavity 4 of the body 3.

The shearing device 1 further provides an eccentric nut 60 which comprises a flat circular head 61 with two parallel diametrically opposed flat surfaces 62 for accepting the jaws of a spanner for tightening purposes, a cylindrical collar 63 concentric with, but of reduced diameter to the circular head 61 and a threaded hole 64 with a longitudinal axis parallel to but offset from the longitudinal axis of the collar 63. A deep groove ball type bearing 65 is concentrically located on the collar 63 of the eccentric nut 60. The bearing 65 and eccentric nut 60 are fastened to the chuck end of the drill 2 by fastening the eccentric nut 60 onto a thread held by the chuck of the drill 2, with a bearing washer 66 located between the adjacent surfaces of the assembled bearing 65 and chuck end of the drill 2. When assembled, the longitudinal axis of the bearing 65 is offset and parallel to the rotational axis of the chuck of the drill 2 by the distance marked D on FIG. 4.

With the body 3 and associated components also fastened to the drill 2, the bearing 65 lies between the cam following surfaces 45,46 of the centre cutting blade 40.

When the drill 2 is operated with the shearing device fitted as described, the bearing 65 moves in an eccentric orbit about the rotational axis of the chuck of the drill 2. Whilst the bearing 65 is moving in a generally upward direction the cam surface 67 of the bearing 65 comes into contact with the cam following surface 45 on the upper arm 43 of the centre cutting blade 40 and drives the arm in a generally upward direction until the bearing 65 reaches the apex of its orbit, causing the centre cutting blade 40 to rotate about the shoulder bolt 53 longitudinal axis, which propels the cutting edge of the centre cutting blade 40 in a generally downward direction rotating the cutting edge away from that on the outer cutting blades 20 in a scissor type opening action. As the cam surface 67 moves across the cam following surface 45 the bearing 65 freely rotates about its own axis reducing wear due to contact between the cam surface 67 and cam following surface 45.

As the bearing 65 continues its orbit beyond the apex and commences a generally downward motion, the cam surface 67 contacts the cam following surface 46 of the lower arm 44, driving it in a generally downward direction, rotating the centre cutting blade 40 in the opposite direction, thereby rotating the cutting edge toward that of the outer cutting blades 20 in a closing scissor action. In continuous operation, the upper and lower arms 43,44 of the centre cutting blade 40 are driven in an oscillating motion which opens and closes the vertical gap between the cutting edges of the cutting blades 20,40 in a scissor action. The horizontal gap between the cutting blades 20,40 remains fixed by the thickness of the spacer plates 30.

The material to be cut is positioned with an edge to be cut between the cutting blades 20,40. As the blades 20,40 close under scissor action the tungsten carbide inserts 21,41 contact the upper and lower surfaces of the material, providing a shear force which cuts through the material as the cutting blades further close. Successive cuts are made as the blades 20,40 continue opening and closing under scissor action, with the shearing device 1 being driven along the profile to be cut as the cut progresses.

The geometry, horizontal positioning and surface texture of the cutting blades 20,40 and the use of tungsten carbide inserts 21,41 in the blades as described in this embodiment allow compressed cement up to 6 mm thick and non compressed cement products, plasterboard and gypsun based products up to 12 mm thick to be cut substantially dust free, without or substantially without tearing or crushing and with a greatly reduced wear rate compared to the prior art. A similar embodiment of larger scale allows compressed cement up to 12 mm thick and non compressed cement products, plasterboard and gypson based products up to 20 mm thick to be cut, with the advantages detailed above. Use of a further tungsten carbide insert 47 on the cam following surface 46 also greatly reduces wear of the surface which is driven under force in the closing phase of the scissor action. The preferred drill 2 speed is dependent on the material to be cut, with thicker material requiring a lower speed.

What I claim is:

1. A shearing device for cutting boards of particulate material, or similar, comprising:

a body adapted for fastening to a drill, first and second cutting blades each fixed to said body, each said cutting blade having a curved cutting edge extending to a forward tip of its respective cutting blade, a third cutting blade adapted to reciprocate in a plane between said first and second cutting blades, said third cutting blade having curved cutting edges extending to a forward tip of said third cutting blade and being free to pivot about an axis so as to cooperate with said first and second cutting blades to perform a cutting operation, and means for pivoting said third cutting blade, wherein said first and second cutting blades are separated from said third cutting blade by spacer plates.

2. The shearing device of claim 1 wherein said first through third cutting blades are manufactured from case hardened mild steel.

3. The shearing device of claim 1 wherein said first through third cutting blades have a surface roughness of 2 to 5 micron.

4. A shearing device for cutting boards of particulate material, or similar, comprising:

a body adapted for fastening to a drill, first and second cutting blades each fixed to said body, each said cutting blade having a curved cutting edge extending to a forward tip of its respective cutting blade, a third cutting blade adapted to reciprocate in a plane between said first and second cutting blades, said third cutting blade having curved cutting edges extending to a forward tip of said third cutting blade and being free to pivot about an axis so as to cooperate with said first and second cutting blades to perform a cutting operation, and means for pivoting said third cutting blade, wherein said first through third cutting blades have insets forming or substantially forming said cutting edges.

5. The shearing device of claim 4 wherein said inserts are manufactured from tungsten carbide.

6. The shearing device of claim 1 wherein said first and second cutting blades have a thickness of 3 to 10 mm.

7. The shearing device of claim 1 wherein said curved first and second cutting blade cutting edges are curved convexly.

8. The shearing device of claim 7 wherein said convexly curved first and second cutting edges have a radius of 90 to 150 mm.

9. The shearing device of claim 6 wherein said third cutting blade has a thickness of 4 to 12 mm.

10. The shearing device of claim 1, wherein said third cutting blade cutting edges are curved concavely.

11. The shearing device of claim 10 wherein said concavely curved third cutting blade cutting edges have a radius of 40 to 80 mm.

12. The shearing device of claim 1 wherein said spacer plates are 1 to 3 mm thick.

13. The shearing device of claim 1 wherein said means for pivoting said third blade comprises a cam fixed to said drill rotating in an eccentric orbit by operation of said drill and cam following surfaces, on said third blade, contact of said cam on said cam following surfaces pivoting said third blade about said axis to form an oscillatory scissor action between said third blade and said first and second blades.

14. The shearing device of claim 13 wherein said cam following surfaces are convexly curved.

15. The shearing device of claim 14 wherein at least one of said cam following surfaces is formed by or substantially formed by a further insert.

16. The shearing device of claim 15 wherein said further insert is manufactured from tungsten carbide.

17. A shearing device for cutting boards of particulart material, or similar, comprising:

a body adapted for fastening to a drill, first and second cutting blades each fixed to said body, each said cutting blade having a convexly curved cutting edge extending to a forward tip of its respective cutting blade, a third cutting blade adapted to reciprocate in a plane between said first and second cutting blades, said third cutting blade having concavely curved cutting edges extending to a forward tip of said third cutting blade and being free to pivot about an axis so as to cooperate with said first and second cutting blades to perform a cutting operations, a first spacer plate separating said first and third cutting blades, a second spacer plate separating said second and third cutting blades, and means for pivoting said third cutting blade.

18. A shearing device for cutting boards of particulate material, or similar, comprising:

a body adapted for fastening to a drill, first and second cutting blades each fixed to said body, each said cutting blade having a curved cutting edge extending to a forward tip of its respective cutting blade, a third cutting blade adapted to reciprocate in a plane between said first and second cutting blades, said third cutting blade having curved cutting edges extending to a forward tip of said third cutting blade and being free to pivot about an axis so as to cooperate with said first and second cutting blades to perform a cutting operation, means for pivoting said third cutting blade, and means by which said first blade cutting edge and the cooperating third blade cutting edge, and said second blade cutting edge and the cooperating third blade cutting edge, are each spaced by spacer means by 1 to 3 mm.

* * * * *